US009799969B2

(12) United States Patent
Lee

(10) Patent No.: US 9,799,969 B2
(45) Date of Patent: Oct. 24, 2017

(54) SIGNAL LEAD ADAPTER

(71) Applicant: Chun-Te Lee, Taichung (TW)

(72) Inventor: Chun-Te Lee, Taichung (TW)

( * ) Notice: Subject to any disclaimer, the term of this patent is extended or adjusted under 35 U.S.C. 154(b) by 0 days.

(21) Appl. No.: 15/072,095

(22) Filed: Mar. 16, 2016

(65) Prior Publication Data

US 2017/0271787 A1 Sep. 21, 2017

(51) Int. Cl.

| | |
|---|---|
| ***H01R 4/60*** | (2006.01) |
| ***H01R 4/48*** | (2006.01) |
| *H01R 13/428* | (2006.01) |
| *H01R 11/22* | (2006.01) |
| *H01R 43/16* | (2006.01) |

(52) U.S. Cl.

CPC ..... *H01R 4/60* (2013.01); *H01R 4/4818* (2013.01)

(58) Field of Classification Search

CPC ..... H01R 24/542; H01R 2103/00; H01R 13/111; H01R 4/4818; H01R 9/0503; H01R 13/15; H01R 43/16; H01R 11/22; H01R 13/11; H01R 13/187; H01R 13/428

USPC ..... 439/578, 654, 638, 851, 852, 857, 268, 439/439, 63, 787, 84

See application file for complete search history.

(56) References Cited

U.S. PATENT DOCUMENTS 5,863,226 A * 1/1999 Lan ..... H01R 9/0503 439/578
5,865,654 A * 2/1999 Shimirak ..... H01R 13/11 439/578
6,250,960 B1 * 6/2001 Youtsey ..... H01R 9/0503 439/578
6,276,970 B1 * 8/2001 Wong ..... H01R 24/542 439/578
6,398,593 B1 * 6/2002 Yeh ..... H01R 31/06 439/654
6,595,799 B2 * 7/2003 Yao ..... H01R 24/44 439/578
6,808,426 B2 * 10/2004 Liu ..... H01R 24/542 439/578
6,899,563 B1 * 5/2005 Lee ..... H01R 24/40 439/578
8,083,544 B2 * 12/2011 Chee ..... H01R 24/542 439/578
8,298,020 B1 * 10/2012 Chen ..... H01R 4/4818 439/852

(Continued)

*Primary Examiner* — Amy Cohen Johnson
*Assistant Examiner* — Matthew T Dzierzynski
(74) *Attorney, Agent, or Firm* — Ming Chow; Sinorica, LLC

(57) ABSTRACT

A signal lead adapter according to the present invention comprises at least a clamper which is formed at one end of a base plate and two clamping plates integrally formed with and upwardly extending from the base plate. Each clamping plate comprises a first clamping section with a predetermined length and a first clamping surface forming into a first holding ditch with a first radius. Each clamping plate also comprises a second clamping section with a predetermined length and a second clamping surface forming a second holding ditch with a second radius. The signal lead of different radius can be inserted and hold in either the first holding ditch or the second holding ditch. The signal lead can be inserted into the adapter and pulled out from the same easily without causing damage of the flexibility as well as the metal coating layer of the clamping plates.

11 Claims, 12 Drawing Sheets

(56) References Cited

U.S. PATENT DOCUMENTS

| | | | | |
|---|---|---|---|---|
| 8,702,456 | B1 * | 4/2014 | Wang | H01R 13/111<br>439/578 |
| 8,888,527 | B2 * | 11/2014 | Chastain | H01R 24/542<br>439/578 |
| 9,431,728 | B2 * | 8/2016 | Shaw | H01R 9/0503 |

* cited by examiner

SIGNAL LEAD ADAPTER

BACKGROUND OF THE INVENTION

Field of the Invention

The present invention relates to a signal lead adapter.

Brief Description of the Prior Art

Conventional signal cable will be connected to electrical appliance to feed the signal into the same with its central metal lead wire being inserted into a socket with a central bore to receive the cable metal lead. It has been noted that different signal cable may have metal lead in different diameter. Therefore, socket with different diameter of their central bore shall be needed. Apparently this is very inconvenient to install the signal cable.

A kind of conventional signal lead clamping device was developed and used with a very simple structure. It is substantially a metal plate with two side pieces bent upwardly to forming a clamp portion. The clamp portion is generally in a structure like a ditch with circular section to receive the metal lead of the signal cable. The metal lead of a signal cable will be clamped at the clamp portion between the side pieces due to the flexibility of the same. The metal lead of the signal cable is therefore clamped by the device. However, it is easily understood that the holding of metal lead is simply based on the flexibility of the metal piece used to form the clamping device. It is not a tight and stable connection. Another disadvantage is the contact between the metal lead and the side pieces is not good enough particularly when the diameter of the metal lead is relatively large. Sometimes when the side pieces of the clamping device are having metal coating, the coated layer is easily damaged because of the loose connection of the signal lead. Therefore, the signal transmission efficiency is poor.

SUMMARY OF THE INVENTION

It is therefore the principle object of the present invention is to provide a signal lead adapter which can be used to hold the connection of the signal cable firmly and stable.

Another object also an advantage of the present invention is to provide a signal lead adapter which can clamp the metal lead of the signal cable with different diameter.

Still another object and advantage of the signal lead adapter according to the present invention is to provide a clamper with clamping plates forming a plurality clamping sections to hold the signal metal lead of different diameter firmly without damage the metal coating of the clamping plates.

A main feature of the signal lead adapter is to provide a clamper with clamping plates forming a plurality clamping sections to hold the signal metal lead of different diameter.

A further feature of the signal lead adapter is to provide a clamper with clamping plates forming a plurality clamping sections having a plurality of clamping surfaces to hold the signal metal lead of different diameter.

A still further feature of the signal lead adapter is to provide a clamper with clamping plates forming a plurality clamping sections in a structure of a metal lead holding ditch with a radial sectional view in a circular shape. The radius of the ditch can be different to hold the signal metal lead of different diameter.

Another feature of the signal lead adapter is to provide a clamper with clamping plates forming a plurality clamping sections which formed with a plurality of conical ribs to hold the signal metal lead firmly and stable.

Therefore, the signal lead adapter according to the present invention comprises at least a clamper which is formed at one end of a base plate made of metal and two clamping plates integrally formed with and upwardly extending from the base plate. Each clamping plate comprises a first clamping section with a predetermined length and a first clamping surface to conjunctively forming into a first holding ditch with a first radius. Each clamping plate also comprises a second clamping section with a predetermined length and a second clamping surface to conjunctively shaping a second holding ditch with a second radius. The signal lead of different diameter can be hold in either the first holding ditch or the second holding ditch.

BRIEF DESCRIPTION OF THE DRAWINGS

Those and other objects, advantages and features of the signal lead adapter according to the present invention will become apparent as described in the detail description of the preferred embodiments with reference to the accompanying drawings, wherein.

DETAILED DESCRIPTION OF THE PREFERRED EMBODIMENTS

Figure 1:
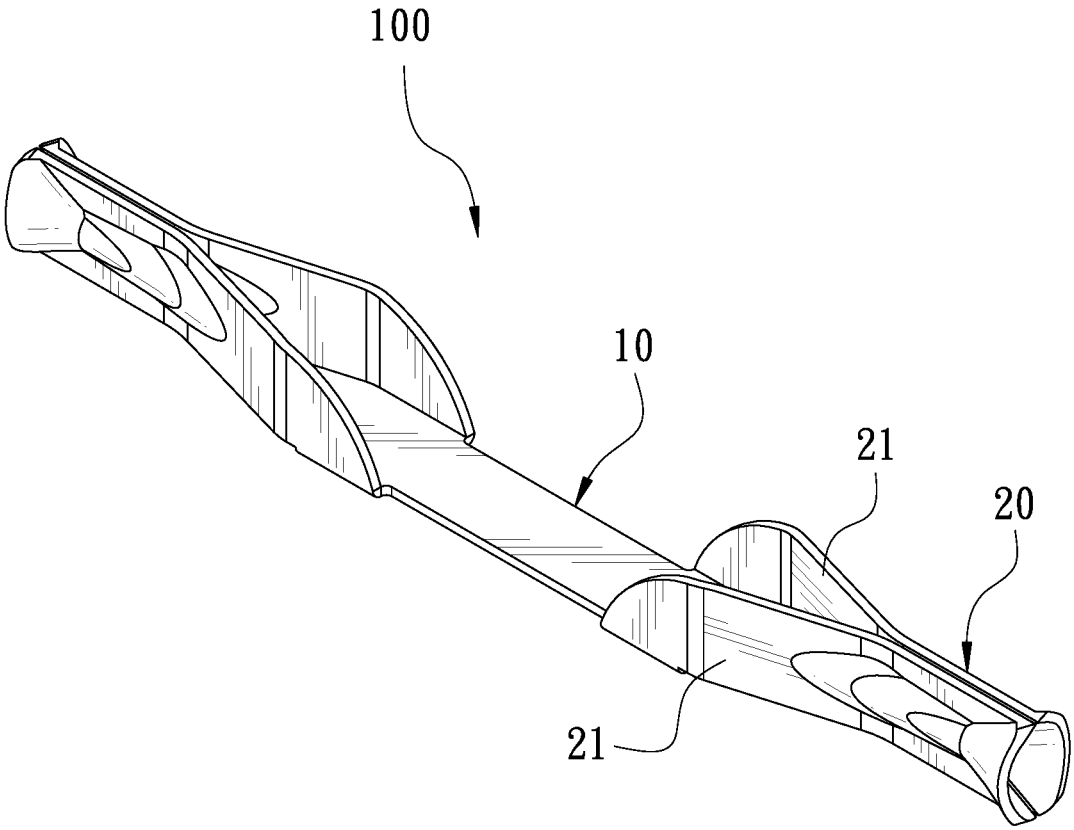
FIG. 1 is a perspective view of a first embodiment of a signal lead adapter according to the present invention.
Figure 2:
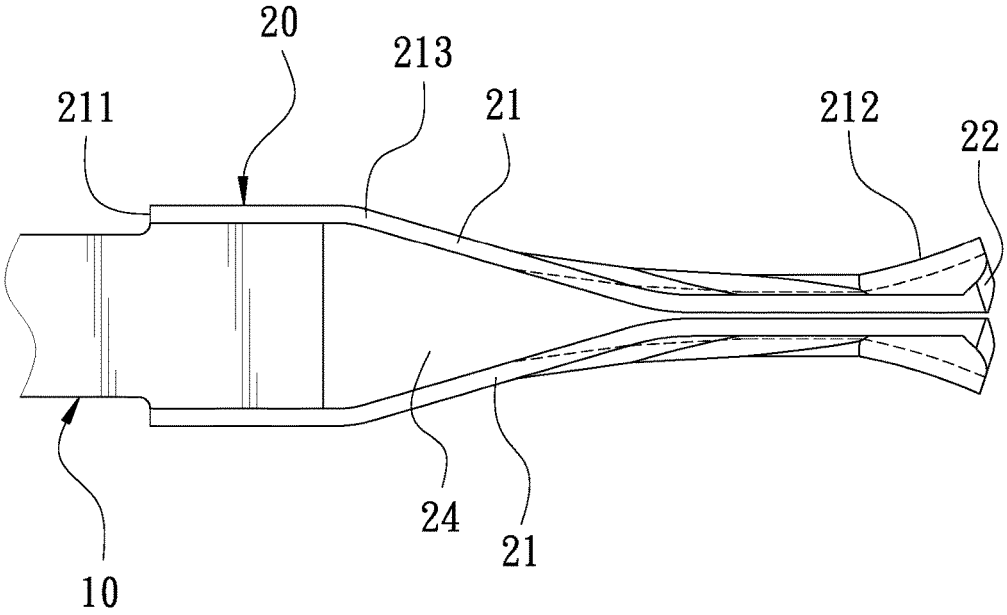
FIG. 2 is a top view of portion of the first embodiment of a signal lead adapter according to the present invention.

Referring to FIG. 1 and FIG. 2 which show a perspective view and a top view of a first embodiment of a signal lead adapter according to the present invention, the signal lead adapter 100 comprises a base plate 10 which is made of metal and electrically conductive material. There are two clamper 20 integrally formed at each end of the base plate 10. The clamper 20 comprises two clamping plates 21 each protruding upwardly from said base plate 10. The clamping plate 21 has a first end 211 and a second end 212.

Figure 3:
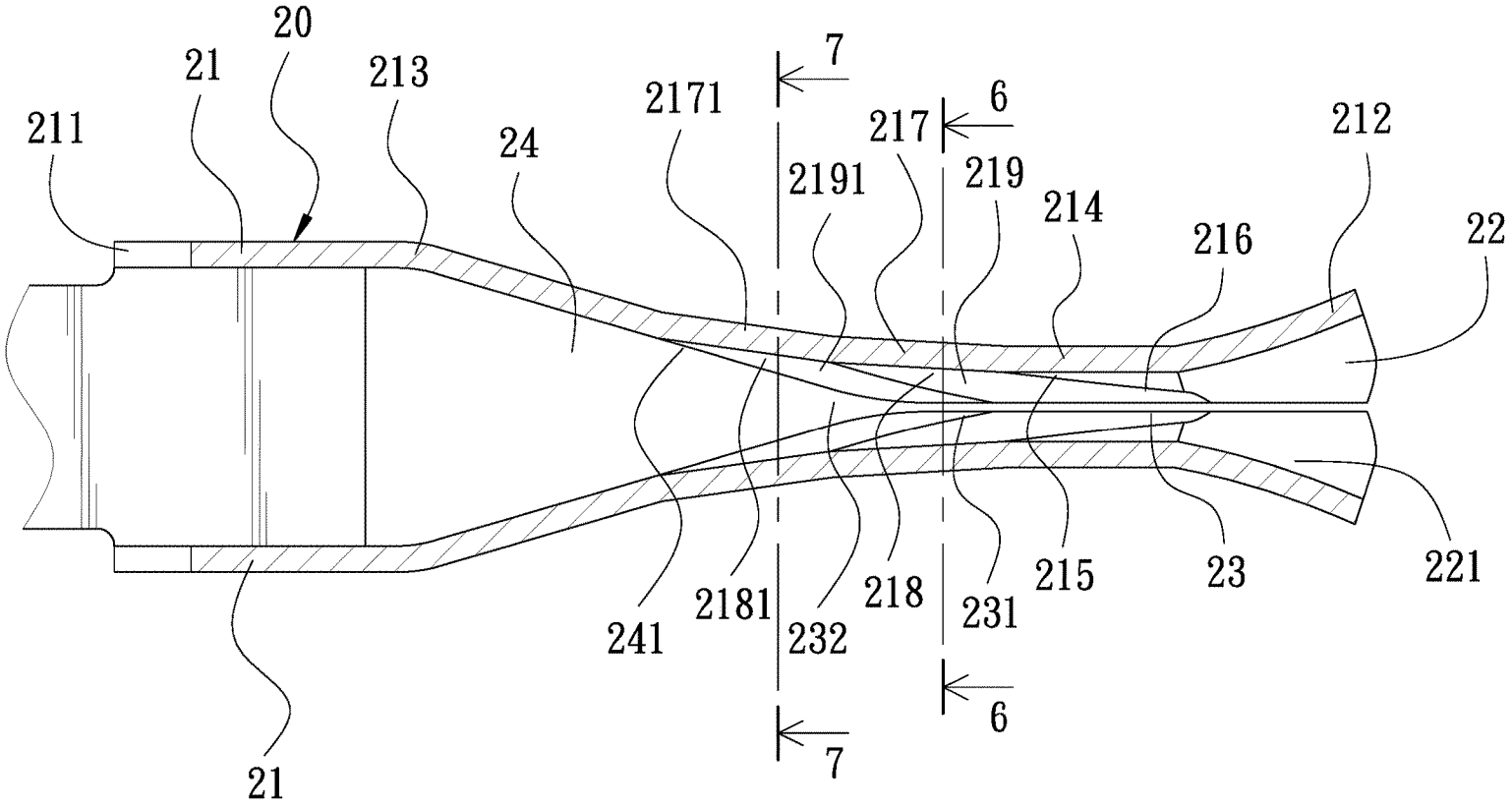
FIG. 3 is an axial sectional view of portion of the first embodiment of a signal lead adapter according to the present invention.

In addition to refer to FIG. 3 which is an axial sectional view of portion of the first embodiment of a signal lead adapter according to the present invention, each of the clamping plate 20 has an arc shaped arm 213 gradually bend inwardly with their inner surface approaching each other forming a clamping or holding ditch. The second end 212 of the clamping plate 21 is formed into a first opening 22 which is substantially as a trumpet shape inlet 221. The portion of the trump shape inlet 221 having a maximum radius extends into the middle portion of the first opening 22 so as to allow the signal lead to be inserted into the adapter from the trump shape inlet 221.

Figure 4:
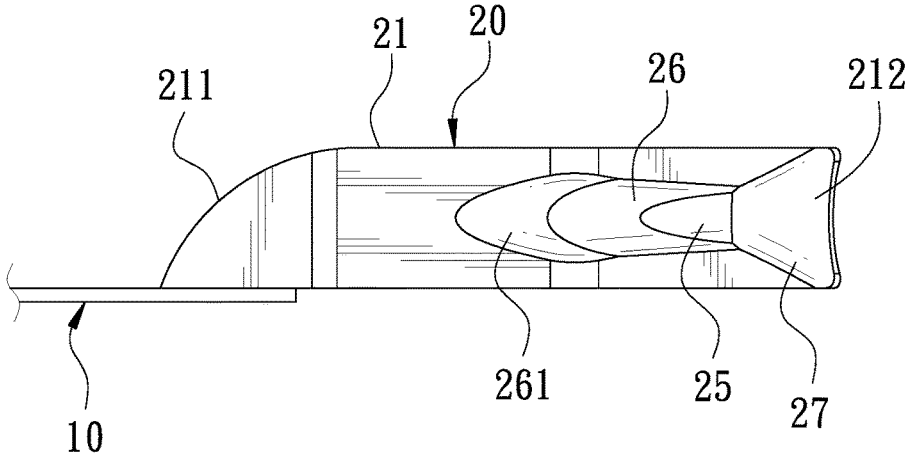
FIG. 4 is a front view of portion of the first embodiment of a signal lead adapter according to the present invention showing the conical ribs.

In addition to refer to FIG. 4 which is a front view of portion of the first embodiment of a signal lead adapter according to the present invention, the first end 211 of the clamping plate 21 is formed into a second opening 24. The second opening 24 has a concave exit portion 241. A first conical rib 25 is formed on the corresponding outer surface of the clamping plate 21. Second conical ribs 26, 261 are formed on the second circular tubes 231, 232 with a protrusion 27 formed at the trumpet shape inlet 221.

Figure 5:
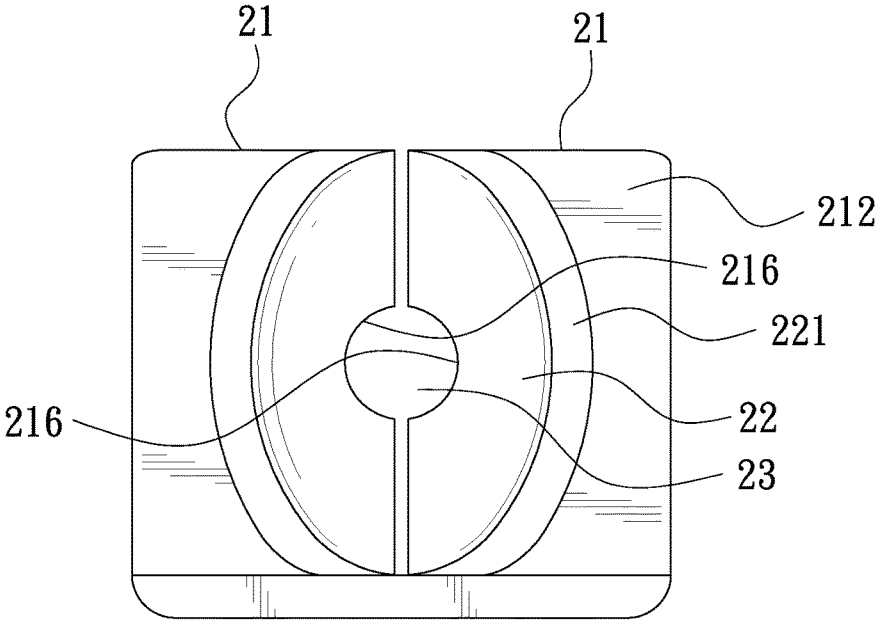
FIG. 5 is a sectional view along the first holding ditch of the first embodiment of a signal lead adapter according to the present invention.

Referring particularly to FIG. 3 which is an axial sectional view of portion of the first embodiment of a signal lead adapter according to the present invention, the two clamping plates 21 form a first clamp section 214 with a predetermined length. At the first clamp section 214, there are substantially parallel first clamping surface 215 and a first lead holding ditch 216. A first circular tube 23 is formed in the first lead holding ditch 216 to receive the signal lead. With reference to FIG. 5 which is a sectional view along the first holding ditch 216 of the first embodiment of a signal lead adapter according to the present invention, it is noted that the radial section of the first holding ditch 216 is semi circular making the radial section of the tube 23 is circular.

Figure 6:
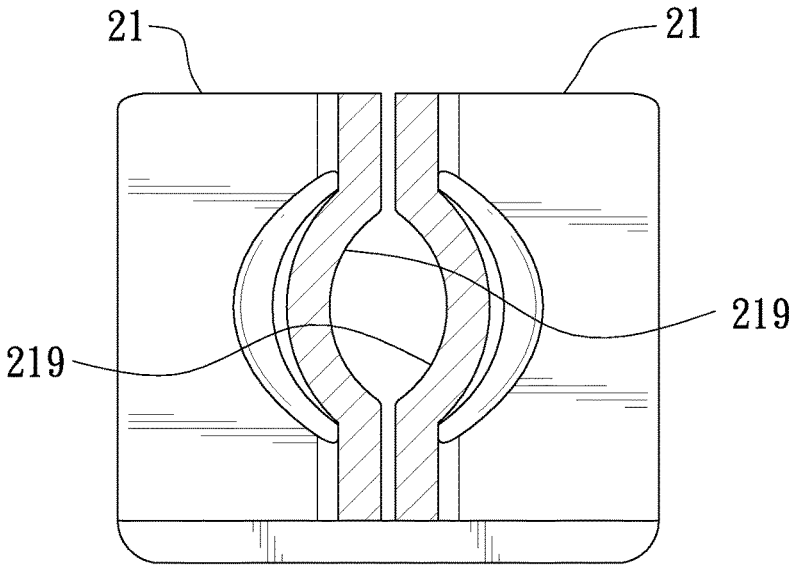
FIG. 6 is a sectional view along line 6-6 of FIG. 3 of the first embodiment of a signal lead adapter according to the present invention.
Figure 7:
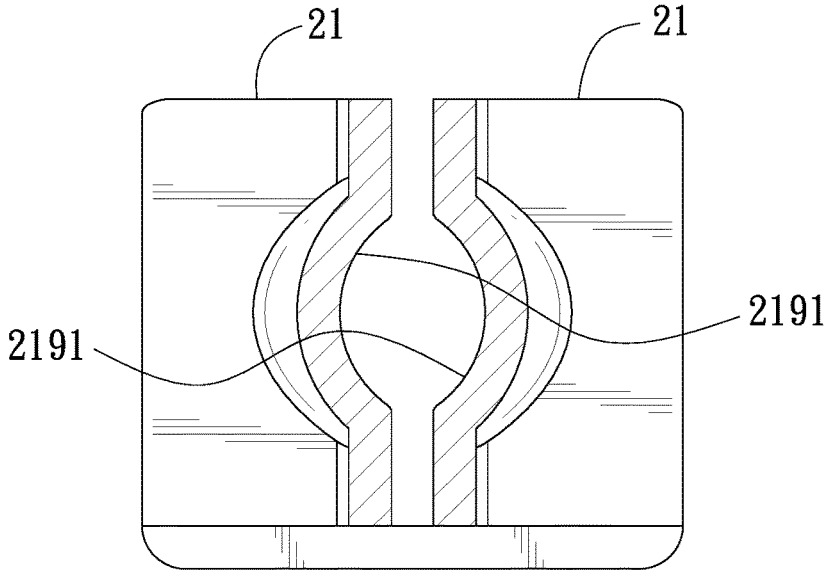
FIG. 7 is a sectional view along line 7-7 of FIG. 3 of the first embodiment of a signal lead adapter according to the present invention.

Still referring to FIG. 3 with reference to FIGS. 6 and 7 which are sectional views along line 6-6 and line 7-7 of FIG. 3 of the first embodiment of a signal lead adapter according to the present invention, there are second clamp sections 217, 2171 having second clamping surface 218, 2181 to form second lead holding ditch 219, 2191. In this embodiment, the second lead holding ditch 219, 2191 have sectional radius r2 and r3 respectfully which is larger than the section radius r1 of the first circular tube 23.

Figure 8:
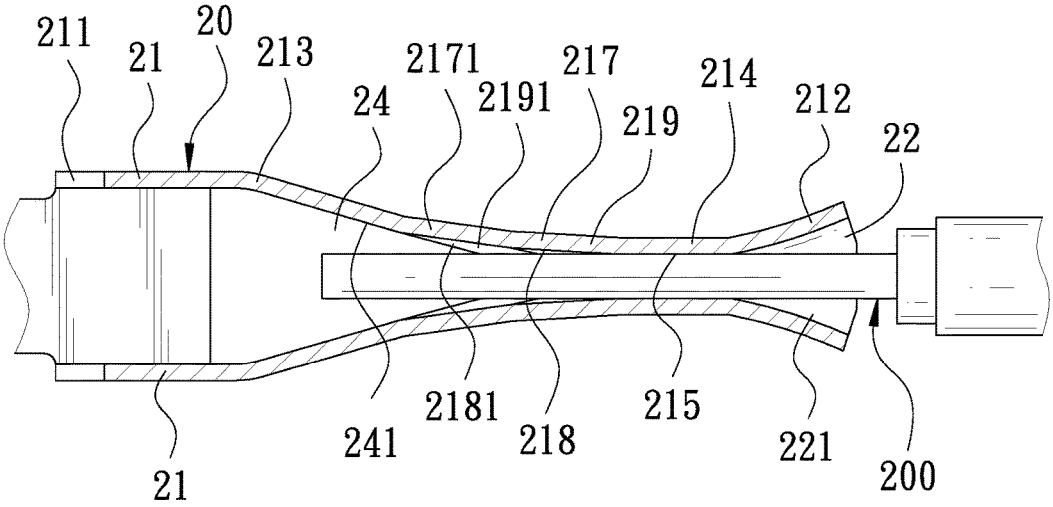
FIGS. 8 and 9 are illustrative axial and radial sectional views of the first embodiment of a signal lead adapter according to the present invention with a signal lead having radius r1 being inserted and hold in the lead holding ditch.
Figure 9:
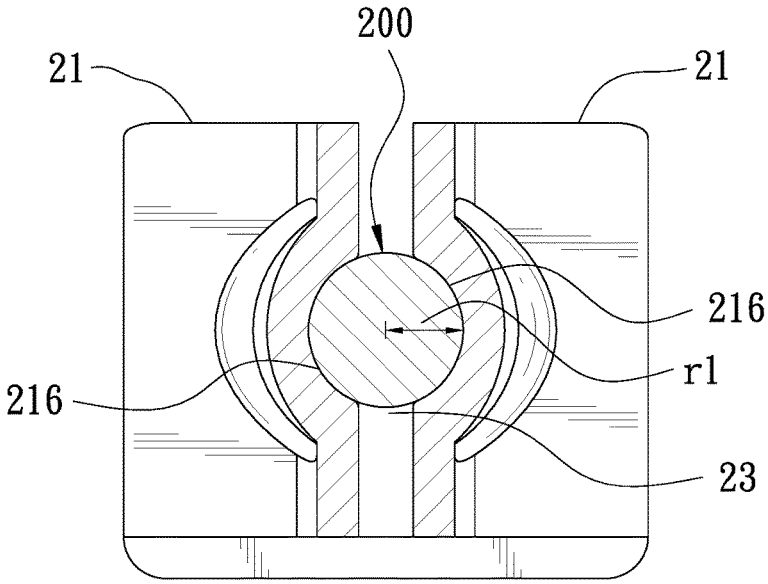

The application of inserting signal lead into the adapter according to the present invention can be easily understood with reference to FIGS. 8 and 9 which are illustrative axial and radial sectional views of the first embodiment of a signal lead adapter according to the present invention with a signal lead having radius r1 being inserted and hold in the lead holding ditch. When a signal lead 200 is to be connected to the adapter, the signal lead 200 will be put at the first trumpet shape inlet 221 and guided into the first circular tube 23. The volume in between the outer surface of the signal lead 200 and the first clamping surface 215 happened to allow the signal lead 200 to be hold in the first lead holding ditch 216 firmly and stable. The flexibility of the arc shaped arm 213 will cause the signal lead 200 to be caught firmly by the clamping plates 21. It is to be further noted that signal lead 200 will not bear large friction when it is retracted from the adapter because the second clamping section 217, 2171 have smaller contact surface with the outer surface of the signal lead 200.

Figure 10:
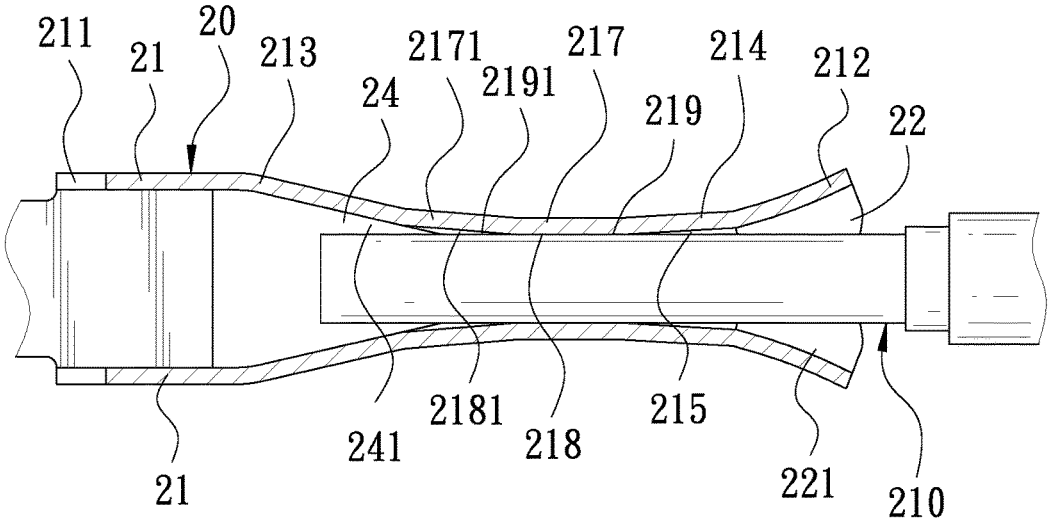
FIGS. 10 and 11 are illustrative axial and radial sectional views of the first embodiment of a signal lead adapter according to the present invention with a signal lead having radius r2 being inserted and hold in the lead holding ditch.
Figure 11:
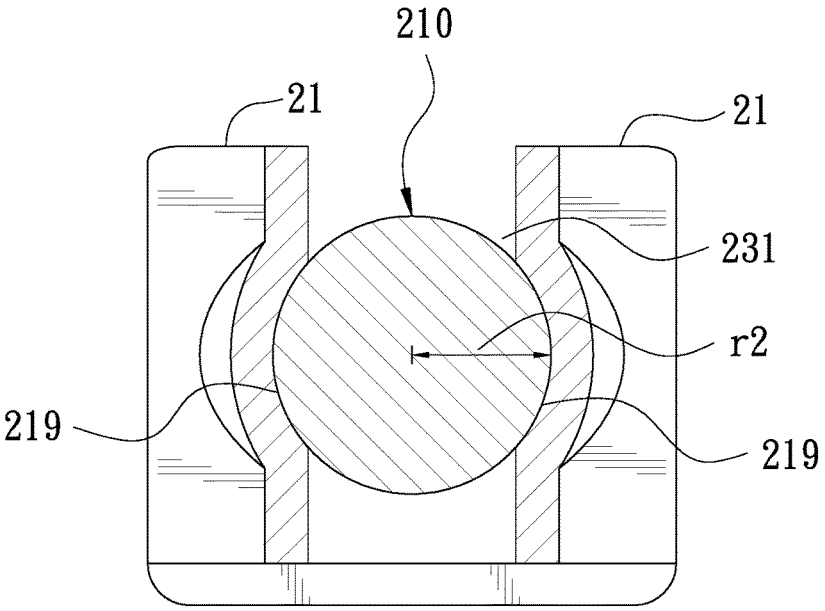

Another application of inserting signal lead into the adapter according to the present invention shall be understood with reference to FIGS. 10 and 11 which are illustrative axial and radial sectional views of the first embodiment of a signal lead adapter according to the present invention with a signal lead having radius r2 being inserted and hold in the lead holding ditch. When a signal lead 210 is to be connected to the adapter, the signal lead 210 will be put at the first trumpet shape inlet 221 and guided into the first circular tube 23. The signal lead 210 has a radius r2 which is slight larger than the inner radius of the first circular tube 23 and will push to enlarge a little bit of the first clamping section 214. The signal lead 210 will then be pushed to the position of the second clamping section 217 and hold by the second lead holing ditch 219. Therefore the signal lead 210 will be hold firmly in the second holding ditch 219 by the flexibility of the arc shaped arm 213.

Figure 12:
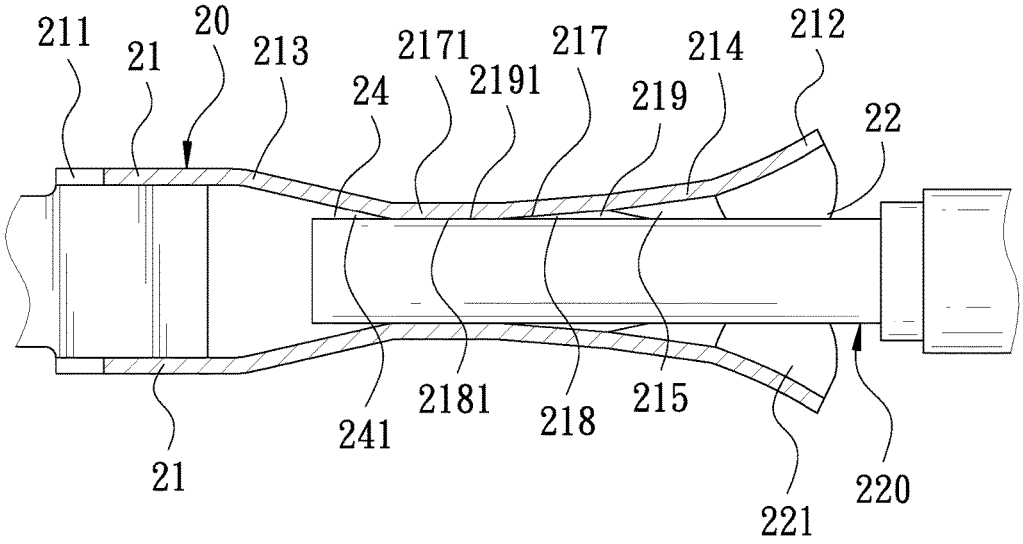
FIGS. 12 and 13 are illustrative axial and radial sectional views of the first embodiment of a signal lead adapter according to the present invention with a signal lead having radius r3 being inserted and hold in the lead holding ditch.
Figure 13:
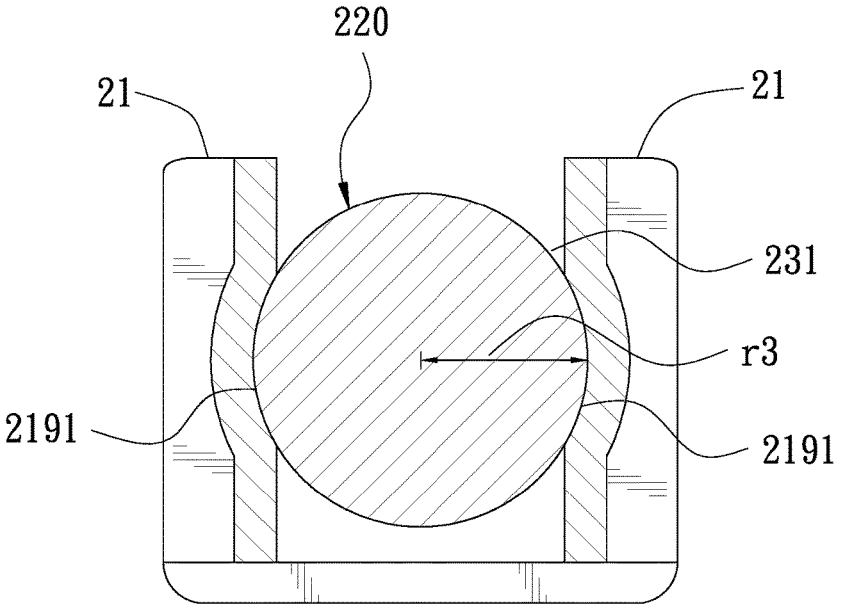

Still another application of inserting signal lead into the adapter according to the present invention shall be understood with reference to FIGS. 12 and 13 which are illustrative axial and radial sectional views of the first embodiment of a signal lead adapter according to the present invention with a signal lead having radius r3 being inserted and hold in the lead holding ditch. When a signal lead 220 is to be connected to the adapter, the signal lead 220 will be put at the first trumpet shape inlet 221 and guided into the first circular tube 23. The signal lead 220 has a radius r3 which is slight larger than the inner radius of the first circular tube 23 and will push to enlarge a little bit of the first clamping section 214. The signal lead 220 will then be pushed to the position of the second clamping section 217 and all the way to second clamping section 2171 and hold by the second lead holing ditch 2191. Therefore the signal lead 220 will be hold firmly in the second holding ditch 2191 by the flexibility of the arc shaped arm 213.

Referring to FIGS. 10 and 12, when signal lead with different radius shall be inserted in the adapter, the signal lead 210, 220 shall be inserted into the first circular tube 23 but clamped in the different second holding ditch 219, 2191 with different second clamping surfaces 218, 2181.

Figure 14:
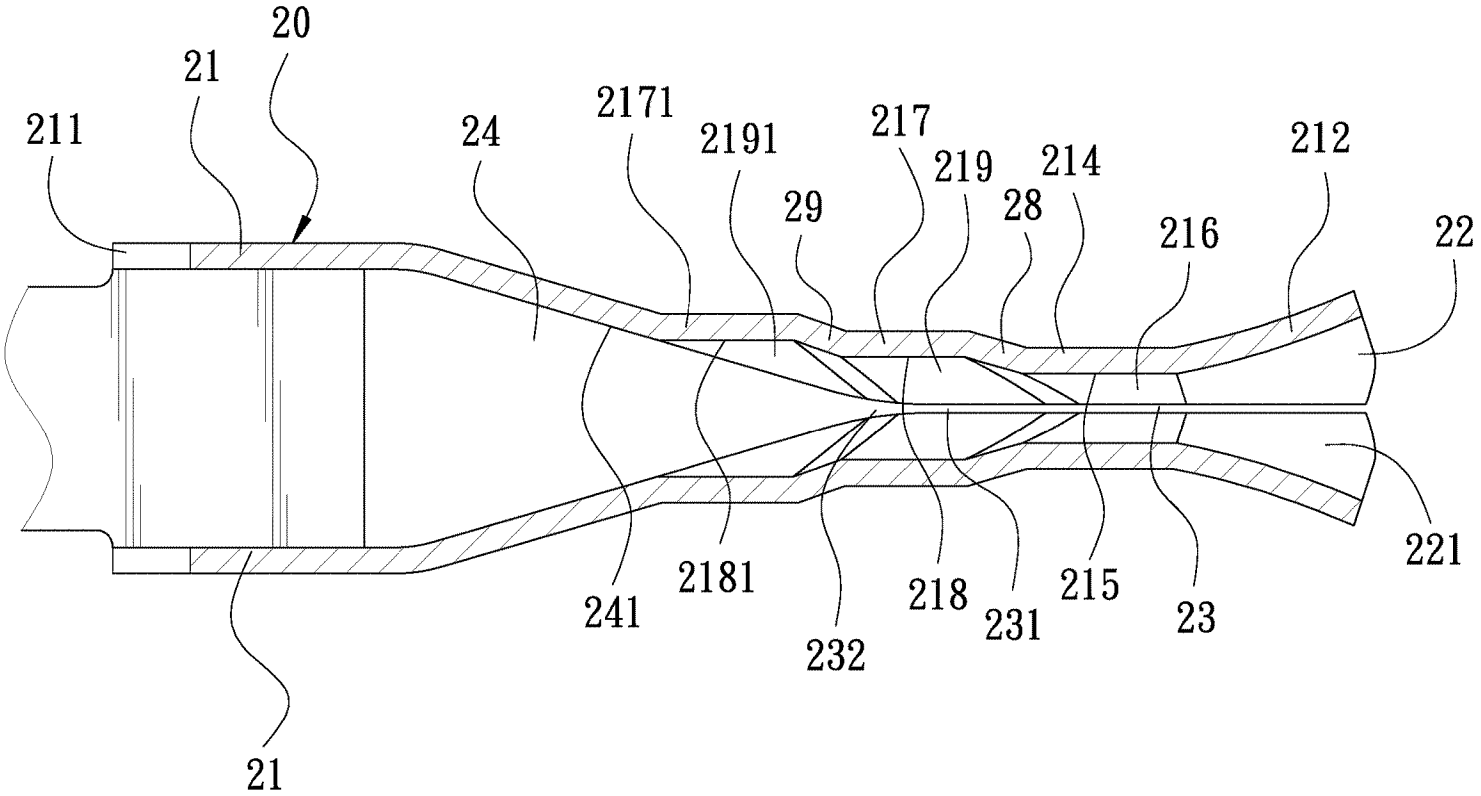
FIG. 14 is an axial sectional view of portion of a second embodiment of a signal lead adapter according to the present invention.

Referring to FIG. 14 which is an axial sectional view of portion of a second embodiment of a signal lead adapter according to the present invention, the structure of the signal lead adapter of this second embodiment is substantially the same as that of first embodiment. Same numerals have been used for those corresponding elements with same structure and function. In this second embodiment, there is a first connecting section 28 which being continued from the first clamping section 214 gradually enlarges toward the second clamping section 217. Another second connecting section 29 is formed between the second clamping sections 217, 2171 and also enlarged toward the base plate 10. With structure of first and second connecting sections 28, 29, the signal lead shall be inserted passing first and second clamping sections 214, 217, 2171 to reach a firm holding. Also with this structure, the signal lead can be inserted into the adapter and pulled out from the same easily without causing damage of the flexibility as well as the metal coating layer of the clamping plates.

Figure 15:
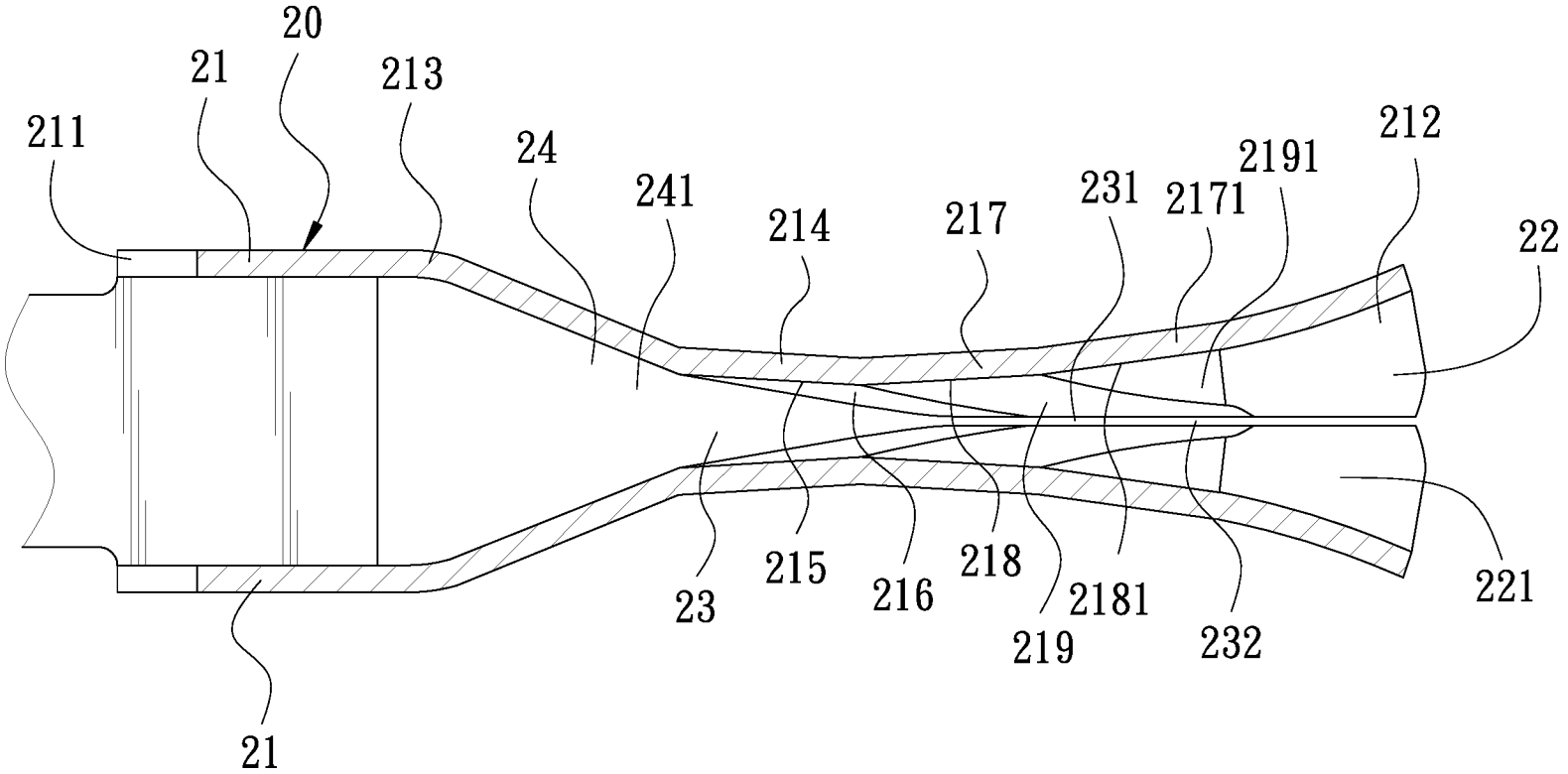
FIG. 15 is an axial sectional view of portion of a third embodiment of a signal lead adapter according to the present invention.
Figure 16:
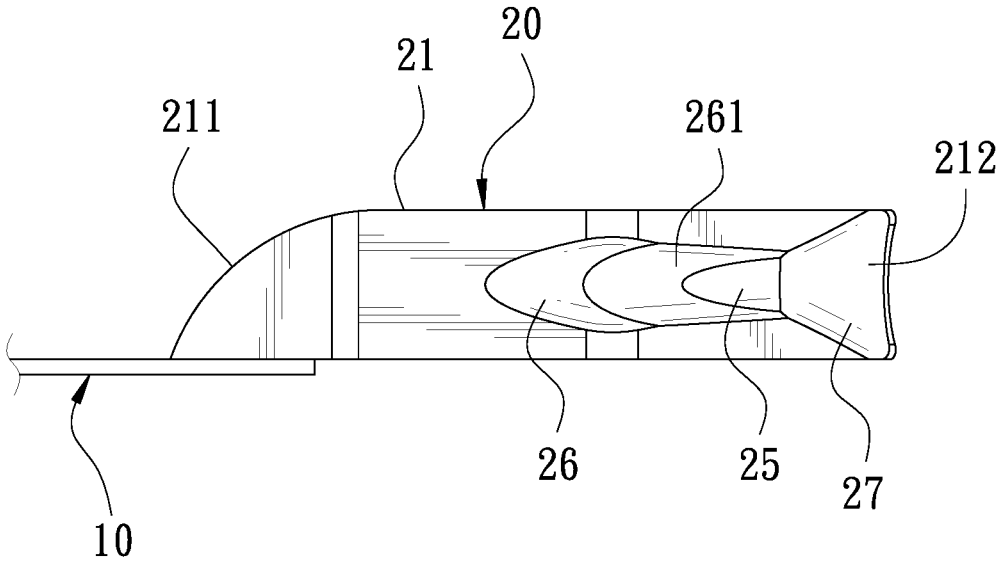
FIG. 16 is a front view of portion of the third embodiment of a signal lead adapter according to the present invention showing the conical ribs.

Referring to FIGS. 15 and 16 which are axial sectional view and a front view of portion of a third embodiment of a signal lead adapter according to the present invention, the structure of the signal lead adapter of this third embodiment is substantially the same as that of first and second embodiments. Same numerals have been used for those corresponding elements with same structure and function. In this third embodiment, the second clamping sections 217, 2171 are formed at the second end 212 of the first clamping section 214. The second circular tubes 231, 232 at the second clamping sections 217, 2171 have a radius greater than the same of the first circular tube 23. The second end 212 of the second clamping section 2171 communicating with second circular tube 232 to form a first opening 22. The second end 211 of the clamping plates 21 forms a second opening 24 with a trumpet shaped exit 241.

With the structure of this third embodiment of the signal lead adapter, it is readily understood that a signal lead of small radius such as r1 can be inserted into the adapter through second circular tube 232, 231 to the circular tube 23 forming a tight connection. The structure of second opening 24 makes the signal lead can be pulled out without touching the arc shaped arm 213 of the clamping plates 21 to avoid damage of the flexibility and coating layer of the clamping plates. When a signal lead with relatively larger radius such as r2 or r3 to be inserted into the adapter, it will be clamped in the second lead holding ditch 219 and 2191 as that shown in FIGS. 11 and 13. The conical ribs 25, 26 and 261 serve the same function as those ribs shown in FIG. 4 of the first embodiment of the signal lead adapter. It is also to be noted when a signal lead of radius r2 being inserted into an adapter, the signal lead will be hold in the second lead holding ditch 219 without enlarging the first circular tube 23. When a signal lead of radius r3 being inserted into an adapter, the signal lead will be hold in the second lead holding ditch 2191 without enlarging the second circular tube 231. Thus, the damage of flexibility of clamping plates in various clamp sections 214, 217, 2171 can be avoided.

Figure 17:
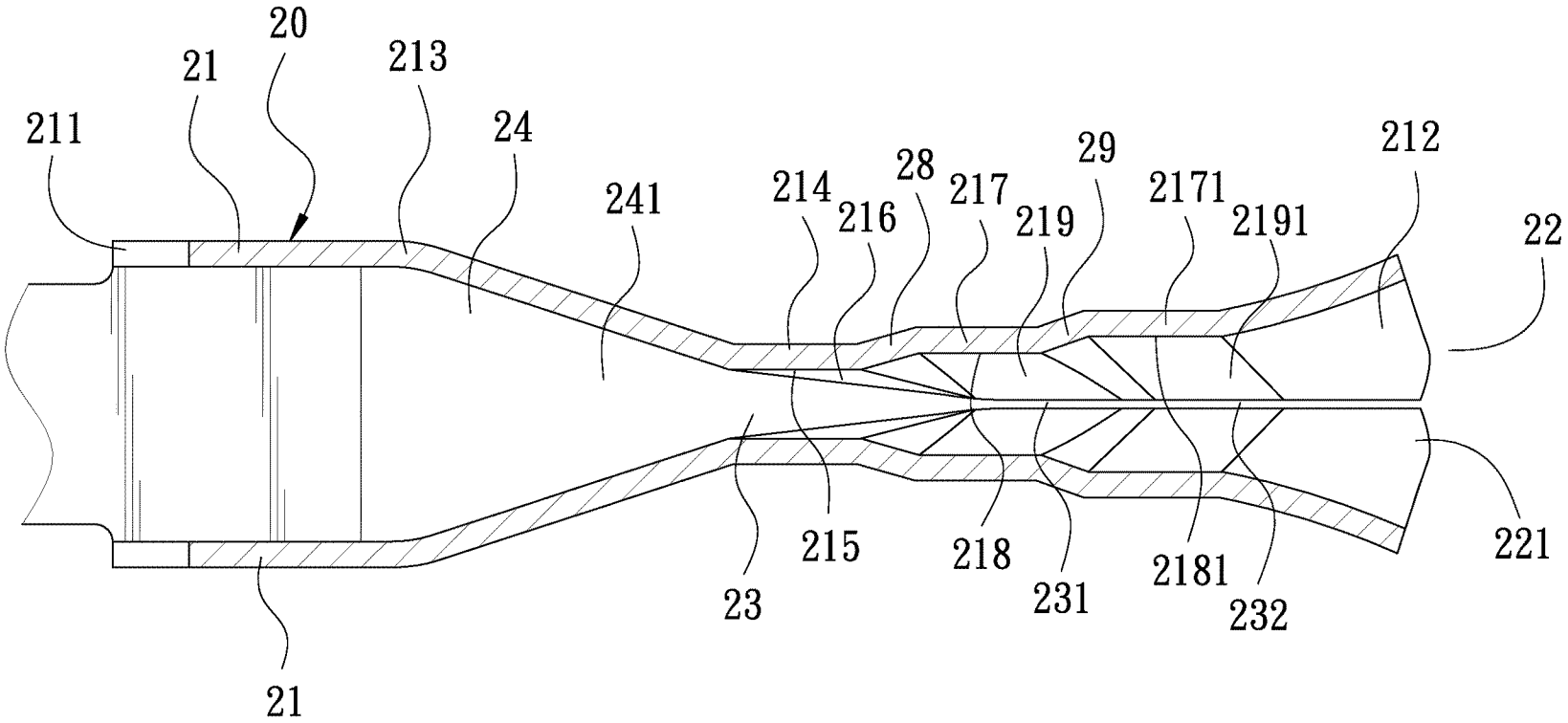
FIG. 17 is an axial sectional view of portion of a fourth embodiment of a signal lead adapter according to the present invention.

Referring to FIG. 17 which is an axial sectional view of portion of a fourth embodiment of a signal lead adapter according to the present invention, once again, the structure of the signal lead adapter of this fourth embodiment is substantially the same as that of said third embodiment. Same numerals have been used for those corresponding elements with same structure and function. The difference in the structure of this fourth embodiment with respect to third embodiment is a first connecting section 28 being formed between the first clamping section 214 and second clamping section 217 gradually enlarged toward second clamping section 217. A second connecting section 29 is formed between the second clamping sections 217, 2171 gradually enlarged toward the base plate 10. With the structure of the first and second connecting sections 28, 29, the advantage of this fourth embodiment is to increase the contact area of the outer surface of signal lead and the various clamping sections 241, 217, 2171 so as to enhance the holding ability of those clamping plates.

Although the signal lead adapter according to the present invention has been described by way of preferred embodiments, other changes and modification can still be made without departing the spirit of the invention and shall be fallen within the protection scope as defined in the appended Claims.

What is claimed is:

1. A signal lead adapter comprising:

a base plate;

a clamper;

the clamper being formed at one end of the base plate;

the clamper comprising two clamping plates;

the two clamping plates of the clamper substantially extending upwardly with respect to the base plate;

the two clamping plates of the clamper each comprising a first clamping surface substantially parallel facing with each other and forming a first clamping section with a predetermined length;

the first clamping section of the clamper being formed adjacent to the one end of the base plate;

each of the first clamping surfaces of the clamper being surrounded so as to form a first lead holding ditch;

the first lead holding ditch of the clamper forming a first circular tube;

the two clamping plates of the clamper each comprising a second clamping surface substantially parallel facing with each other and forming a second clamping section with a predetermined length;

the second clamping section of the clamper being formed in between the first clamping section of the clamper and a center of the base plate;

each of the second clamping surfaces of the clamper being surrounded so as to form a second lead holding ditch;

the second lead holding ditch of the clamper forming a second circular tube;

the first and second circular tubes of the clamper each comprising a radius;

the radius of the second circular tube of the clamper being greater that the radius of the first circular tube of the clamper;

the first circular tube of the clamper being configured to accommodate a signal lead;

the first clamping surface and the second clamping surface of the clamper being configured to clamp the signal lead;

a shape of a radial section of each of the first lead holding ditch and the second lead holding ditch of the clamper being a semi-circular shape;

a shape of a radial section of each of the first circular tube and the second circular tube of the clamper being a circular shape;

the two clamping plates of the clamper each comprising another second clamping surface substantially parallel facing with each other and forming another second clamping section with a predetermined length;

the another second clamping section of the clamper being formed in between the second clamping section of the clamper and the center of the base plate;

each of the another second clamping surfaces of the clamper being surrounded so as to form another second lead holding ditch;

the another second lead holding ditch of the clamper forming another second circular tube;

the another second circular tube of the clamper comprising a radius;

the radius of the another second circular tube of the clamper being greater that the radius of the first circular tube of the clamper;

the another second clamping surface of the clamper being configured to clamp the signal lead;

a shape of a radial section of the another second lead holding ditch of the clamper being a semi-circular shape;

a shape of a radial section of the another second circular tube of the clamper being a circular shape;

the radius of a curvature of each of the second circular tube and the another second circular tube of the clamper gradually increasing or decreasing toward the center of the base plate;

another clamper;

the another clamper being formed at the other one end of the base plate opposite to the one end of the base plate;

the another clamper comprising two clamping plates;

the two clamping plates of the another clamper substantially extending upwardly with respect to the base plate;

the two clamping plates of the another clamper each comprising a first clamping surface substantially parallel facing with each other and forming a first clamping section with a predetermined length;

the first clamping section of the another clamper being formed adjacent to the center of the base plate;

each of the first clamping surfaces of the another clamper being surrounded so as to form a first lead holding ditch;

the first lead holding ditch of the another clamper forming a first circular tube;

the two clamping plates of the another clamper each comprising a second clamping surface substantially parallel facing with each other and forming a second clamping section with a predetermined length;

the second clamping section of the another clamper being formed in between the first clamping section of the clamper and the other end of the base plate;

each of the second clamping surfaces of the another clamper being surrounded so as to form a second lead holding ditch;

the second lead holding ditch of the another clamper forming a second circular tube;

the first and second circular tubes of the another damper each comprising a radius;

the radius of the second circular tube of the another clamper being greater that the radius of the first circular tube of the another clamper;

the first circular tube of the another clamper being configured to accommodate the signal lead;

the first clamping surface and the second clamping surface of the another clamper being configured to clamp the signal lead;

a shape of a radial section of each of the first lead holding ditch and the second lead holding ditch of the another clamper being a semi-circular shape;

a shape of a radial section of each of the first circular tube and the second circular tube of the another clamper being a circular shape;

the two clamping plates of the another clamper each comprising another second clamping surface substantially parallel facing with each other and forming another second clamping section with a predetermined length;

the another second clamping section of the another clamper being formed in between the second clamping section of the clamper and the other end of the base plate;

each of the another second clamping surfaces of the another clamper being surrounded so as to form another second lead holding ditch;

the another second lead holding ditch of the another clamper forming another second circular tube;

the another second circular tube of the another clamper comprising a radius;

the radius of the another second circular tube of the another clamper being greater that the radius of the first circular tube of the another clamper;

the another second clamping surface of the another clamper being configured to clamp the signal lead;

a shape of a radial section of the another second lead holding ditch of the another clamper being a semi-circular shape;

a shape of a radial section of the another second circular tube of the another clamper being a circular shape; and the radius of a curvature of each of the second circular tube and the another second circular tube of the another clamper gradually increasing or decreasing toward the center of the base plate.

2. The signal lead adapter as claimed in claim 1 wherein each of the two clamping plates of the clamper comprises a first connecting section formed between the first clamping section and the second clamping section, the first connecting section of the clamper is gradually enlarged from the first clamping section of the clamper toward the second clamping section of the clamper.

3. The signal lead adapter as claimed in claim 1 wherein the first clamping section of the clamper comprises a first end formed into a first opening which has a concave exit portion communicating with a trumpet shaped exit of the first circular tube of the clamper, the second clamping section of the clamper comprises a second end formed into a second opening which has a concave exit portion communicating with a trumpet shaped exit of the second circular tube of the clamper.

4. The signal lead adapter as claimed in claim 1 wherein the second clamping section of the another clamper comprises a first end formed into a first opening which has a concave exit portion communicating with a trumpet shaped exit of the second circular tube of the another clamper, the first clamping section of the another clamper comprises a second end formed into a second opening which has a concave exit portion communicating with a trumpet shaped exit of the first circular tube of the another clamper.

5. The signal lead adapter as claimed in claim 1 wherein the clamping plate of the clamper comprises a plurality of conical ribs protruding toward the first circular tube and second circular tube of the clamper, the conical rib of the clamper is convex trumpet shaped protruding toward a concave exit portion communicating with a trumpet shaped exit of the second circular tube of the clamper.

6. The signal lead adapter as claimed in claim 1 wherein each of the two clamping plates of the clamper comprises a second connecting section in between the second clamping section and the another second clamping section of the clamper.

7. The signal lead adapter as claimed in claim 1 wherein each of the two clamping plates of the another clamper comprises a second connecting section in between the second clamping section and the another second clamping section of the another clamper.

8. The signal lead adapter as claimed in claim 1 wherein each of the two clamping plates of the another clamper comprises a first connecting section formed between the first clamping section and the second clamping section, the first connecting section of the another clamper is gradually enlarged from the first clamping section of the another clamper toward the second clamping section of the another clamper.

9. The signal lead adapter as claimed in claim 1 wherein the second clamping section of the another clamper comprises a first end formed into a first opening which has a concave exit portion communicating with a trumpet shaped exit of the second circular tube of the another clamper, the first clamping section of the another clamper comprises a second end formed into a second opening which has a concave exit portion communicating with a trumpet shaped exit of the first circular tube of the another clamper.

10. The signal lead adapter as claimed in claim 1 wherein the clamping plate of the another clamper comprises a plurality of conical ribs protruding toward the first circular tube and second circular tube of the another clamper, the conical rib of the another clamper is convex trumpet shaped protruding toward a concave exit portion communicating with a trumpet shaped exit of the first circular tube of the another clamper.

11. The signal lead adapter as claimed in claim 1 wherein each of the two clamping plates of the another clamper comprises a second connecting section in between the second clamping section and the another second clamping section of the another clamper.

* * * * *